US005426407A

United States Patent [19]

Van Den Berg et al.

[11] Patent Number: 5,426,407

[45] Date of Patent: Jun. 20, 1995

[54] HIGH ACCURACY CRT DEFLECTION UNIT

[75] Inventors: Hendrik D. Van Den Berg; Jacobus H. T. Jamar; Bernardus H. J. Dekkers, all of Eindhoven, Netherlands

[73] Assignee: U.S. Philips Corporation, New York, N.Y.

[21] Appl. No.: 272,182

[22] Filed: Jul. 8, 1994

Related U.S. Application Data

[62] Division of Ser. No. 945,475, Sep. 16, 1992, Pat. No. 5,355,578.

[30] Foreign Application Priority Data

Sep. 23, 1991 [EP] European Pat. Off. ..... 91202456
May 18, 1992 [EP] European Pat. Off. ..... 92201398

[51] Int. Cl.[6] ..... H01F 7/00; H01H 1/00; G09G 1/04; H01J 29/70

[52] U.S. Cl. ..... 335/210; 335/213; 315/368.26; 313/421

[58] Field of Search ..... 335/210, 211, 212, 213; 315/368.25, 368.26, 368.28; 313/421, 417, 407

[56] References Cited

U.S. PATENT DOCUMENTS

| | | | |
|---|---|---|---|
| 1,739,246 | 12/1929 | Majce . | |
| 3,541,682 | 11/1970 | Hildebrandt | 29/605 |
| 4,547,238 | 10/1985 | Lenders | 156/73.2 |
| 4,553,120 | 11/1985 | Dam | 335/210 |
| 4,691,746 | 9/1987 | Sedgewick | 140/92.1 |

*Primary Examiner*—Leo P. Picard
*Assistant Examiner*—Stephen T. Ryan
*Attorney, Agent, or Firm*—Robert J. Kraus

[57] ABSTRACT

A deflection unit comprising a set of preformed diametrical deflection coils. A hollow coil support of synethic material includes at least two lugs into which respective permanent deformations are impressed. The coils are mechanically anchored to the lugs by means of, for example, an ultrasonic welding process in which the locations of the coil support situated opposite supported locations of the coils are softened and pressed into the coils. The coils substantially free of the coil support, i.e., the larger part of each coil is free of the coil support, and are not deformed so that their mutual position is accurately maintained.

6 Claims, 3 Drawing Sheets

HIGH ACCURACY CRT DEFLECTION UNIT

This is a division of prior application Ser. No. 07/945,475, filed on Sep. 16, 1992, now U.S. Pat. No. 5,355,578.

BACKGROUND OF THE INVENTION

This invention relates to a method of manufacturing a deflection unit for a cathode ray tube, which method comprises the step of mounting a set of saddle-type deflection coils on a surface of a hollow synthetic material coil support. The invention further relates to a deflection unit made in accordance with the novel method of the invention.

In this respect deflection unit is understood to mean a deflection unit for deflecting an electron beam in the horizontal direction, in the vertical direction or in both directions.

The invention particularly relates to the step of mounting the self-supporting deflection coils (referred to as saddle coils) for deflection in the horizontal direction on the inner surface of a coil support, but the invention is not limited thereto.

In practice, deflection coils have hitherto been mostly mounted (positioned and fixed) on an inner or outer surface of the coil support mechanically, for example, by means of snap connections, projections or other auxiliary means. A drawback of these methods is that the coils are forced to adapt their shape to the shape of the coil support and/or to the shape of the auxiliary means. Tolerances between the support and the coils and differences in expansion between the coils and the support will adversely influence the reproducibility of the deflection fields generated by the deflection units obtained: there will be spreads. Methods in which positioning means such as projections are used for positioning the coils during the mounting operation and in which glues are used for fixing do not provide a substantial improvement in this respect.

SUMMARY OF THE INVENTION

The invention has, inter alia, for its object to provide a novel mounting method which inhibits or eliminates the above-mentioned problems and to a CRT deflection unit produced by the novel method.

A method of the type described in the opening paragraph is therefore characterized in that the deflection coils are placed on a jig which supports the inner surface of each coil at a plurality of locations and in that the inner surface of the coil support is urged against the outer surface of each supported coil, whereafter the material of the coil support is softened for a short period of time by applying thermal energy at locations situated opposite locations where the coils are supported and is urged towards the coils so that the support is pressed into the coils at said locations.

In the method according to the invention the coils are arranged in an accurately spaced relationship by using an (accurately formed) jig during fixing. In this method they maintain their shape. The coil support is deformed and pressed into the coils by locally softening the support material. In this way the undeformed coils are mechanically anchored. This yields an improved reproducibility of the fields generated by a deflection unit comprising a (line) deflection coil system obtained in such a manner.

The operations of locally softening the material of the coil support and pressing the softened material into the coil can be carried out in a very practical manner in one step by making use of an ultrasonic welding method.

The process described above results in a mechanical anchoring of the deflection coils. An increased degree of adhesion can be realised if the coil wires are enveloped by a material which softens during the ultrasonic welding process.

In addition to the above-described advantage, the invention has a further advantage: various types of coils having different dimensions but intended for cathode ray tubes having the same deflection angle and neck diameter can be secured to one type of coil support because projections, snap connections and the like are not required. This is particularly advantageous when a relatively small series of deflection units having different properties are to be manufactured, as in, for example, EVTV.

The method described hereinbefore is based on positioning and fixing (line) deflection coils on the inner surface of a coil support. However, the invention may also be used for positioning and fixing (field) deflection coils on the outer surface of a coil support.

The coils are preferably thermo-stable. Precisely because the effects of dimensioning spreads of the coil supports are eliminated by the method according to the invention, the use of thermo-stable coils is important. The possibilities of implementing the inventive method are enhanced by using (line) deflection coils of the semi-saddle type, or mussel type. These are coils which are wound to form two conductor side groups connected at one extremity by a connection group which is arranged in a plane extending at an angle to the plane in which the side groups are located and at the other extremity by a connection group which is arranged in the plane of the side groups.

A coil support preferably has per coil, or per coil system, at least two reentrant elastic projections (lugs), but, for example, four projections are alternatively possible, and preferably the coils are exclusively secured to these projections in the manner described hereinbefore. This has two advantages:

a. the coils are free from the support (over the greater part of their surface), which reduces spread errors;
b. expansion differences between the coils and the support which may still occur (in spite of the use of thermo-stable coils) are corrected.

The support is preferably made of thermoplastic material. This facilitates the process of securing the coils, particularly when an ultrasonic welding method is used for this purpose.

A practical embodiment is characterized in that, viewed in the longitudinal direction, the support comprises at least two parts: a first part (provided or not provided with lugs) of thermoplastic material to which the coils are secured, and a second part of an arbitrary (for example, low-cost) synthetic material which is moulded or snapped onto, for example, the rear extremity of the first part. (A third part of an arbitrary synthetic material may be moulded or snapped onto the front extremity of the first part.) The second part is particularly suitable for mounting the coil support on the neck of a display tube, for example by means of a clamping ring or clamping strap and may be made of a material suitable for this function. The rear extremity is herein understood to mean the extremity where electron beams enter during operation and the front extremity is understood to mean the extremity where electron beams exit in operation.

The invention thus also relates to a deflection unit having one or more of the features described above.

BRIEF DESCRIPTION OF THE DRAWINGS

These and other aspects of the invention will be apparent from and elucidated with reference to the embodiments described hereinafter.

In the drawings.

DESCRIPTION OF THE PREFERRED EMBODIMENTS

Figure 1:
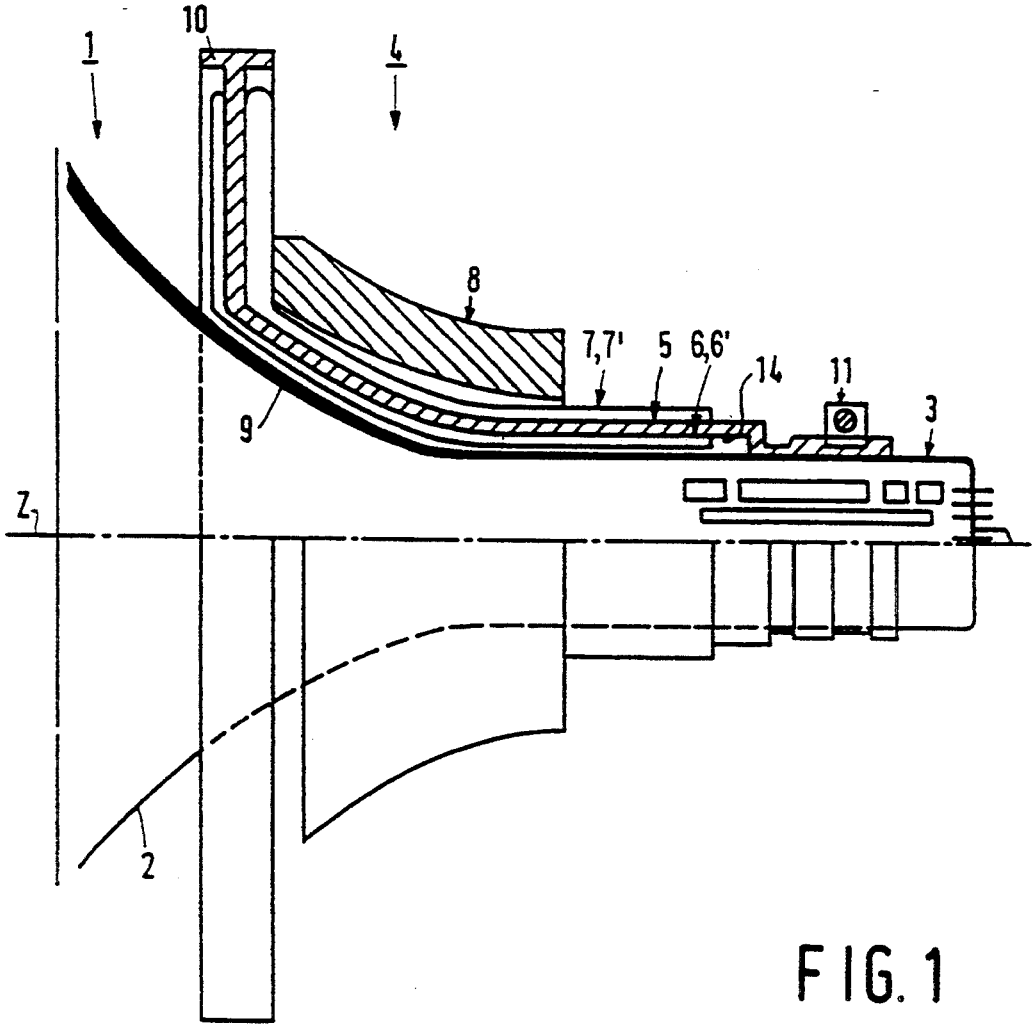
FIG. 1 shows a cathode ray tube with a deflection unit, partly in a side elevation and partly in a longitudinal section.

FIG. 1 shows a cathode my tube 1 having a funnel-shaped portion (cone) 2 and a neck 3. A deflection unit 4 with a coil support 5 manufactured from a synthetic material and supporting a set of vertical or field deflection coils 6, 6', a set of horizontal or line deflection coils 7, 7' and a yoke ring 8 is placed on the envelope of the display tube and its front end 10 is supported by the funnel-shaped portion 2. For providing support in the correct position, use may be made of, for example, adjusting members such as bolts or pins (not shown). After the deflection unit 4 is slid on the neck 3, its position is fixed by means of a clamping strap 11.

Figure 2:
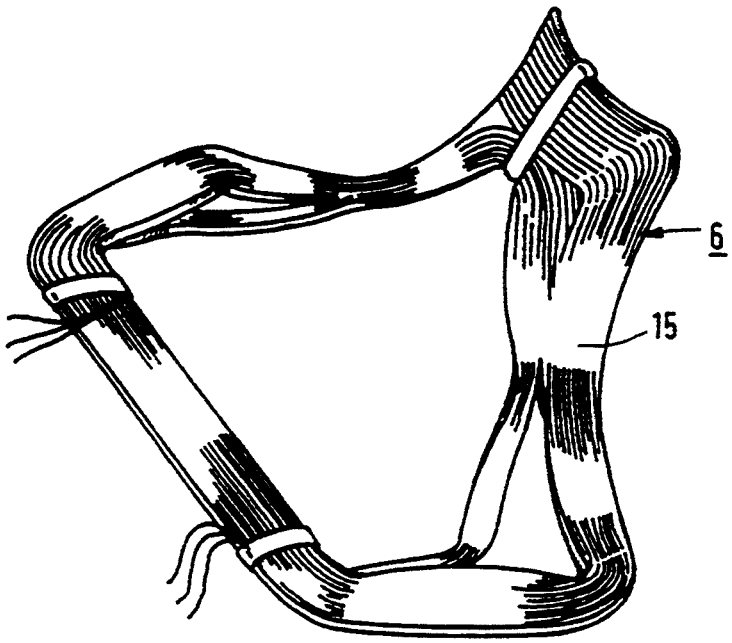
FIG. 2 is a perspective elevational view of a (line) deflection coil.
Figure 3:
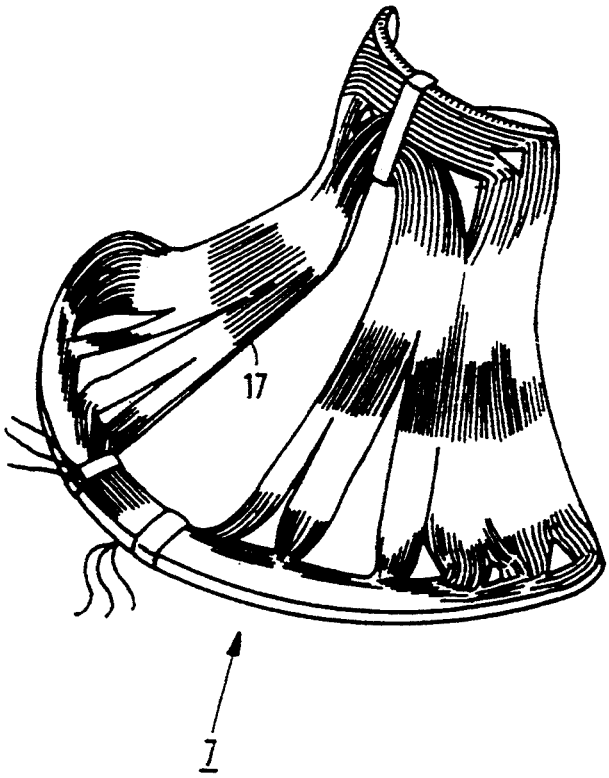
FIG. 3 is a perspective elevational view of a (field) deflection coil.

An example of a line deflection coil 6 is shown in FIG. 2 and an example of a field deflection coil 7 is shown in FIG. 3.

As is shown in FIG. 1, the line deflection coil 6 is secured to the inner surface 14 of the coil support 5. The deflection coils are positioned and fixed within the scope of the invention in the following manner.

Figure 4:
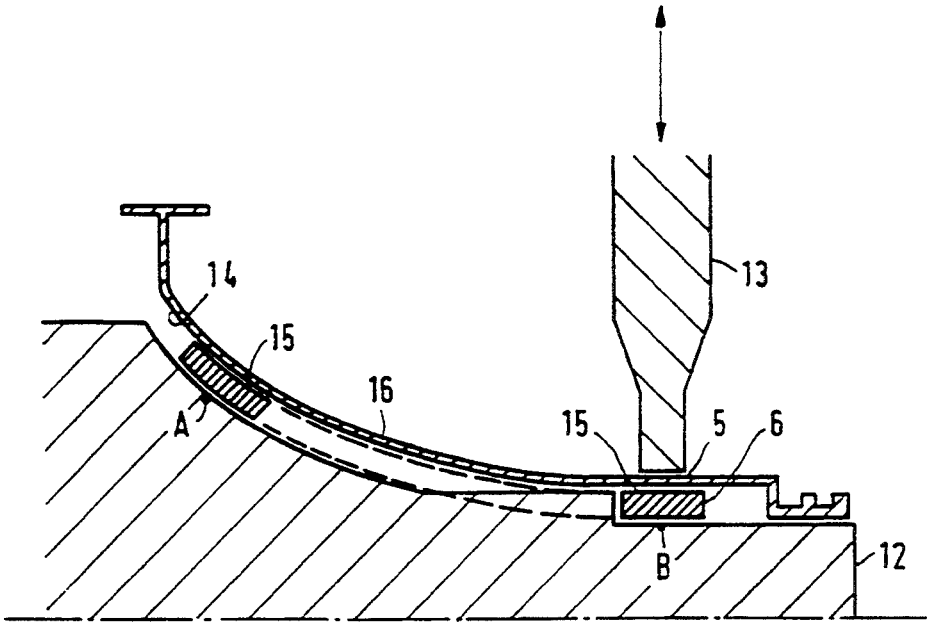
FIG. 4 shows diagrammatically a step of the inventive method of positioning and fixing deflection coils on a coil support.
Figure 5:
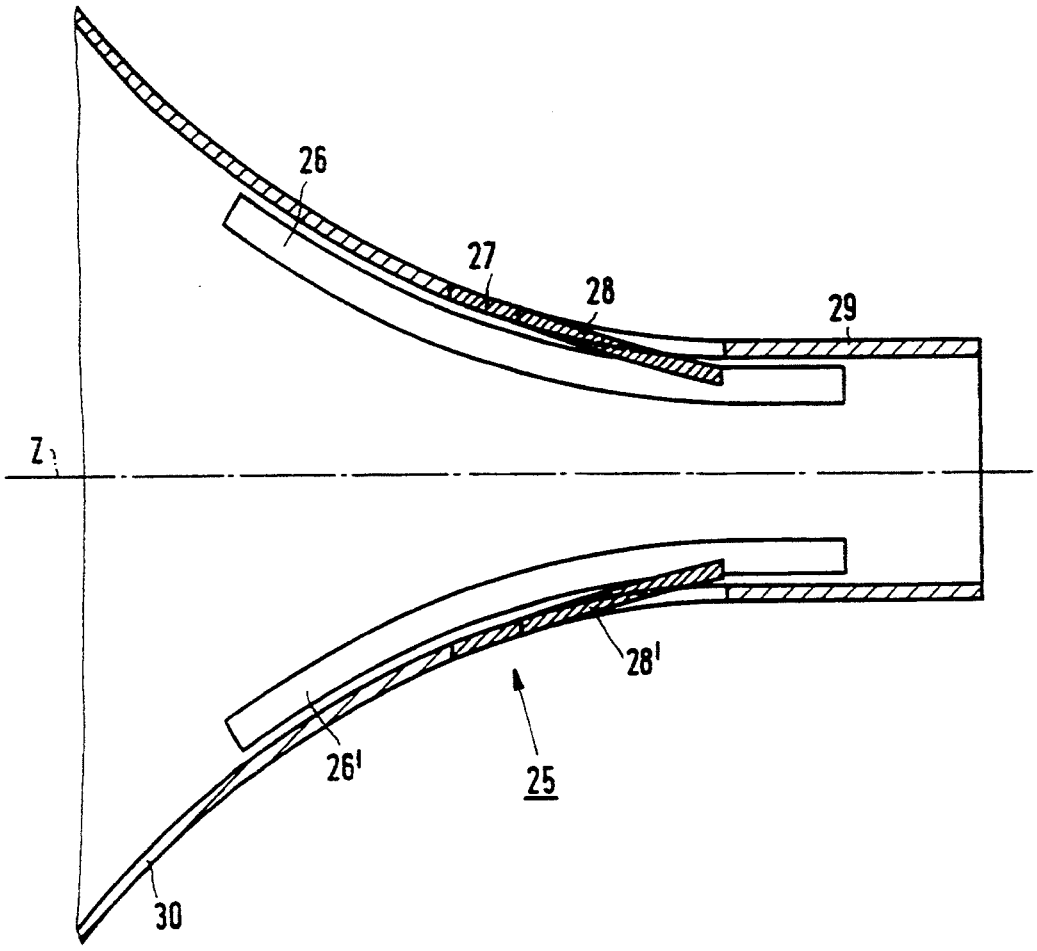
FIG. 5 is a longitudinal section of a coil support which is very suitable for achieving the object of the invention.

The saddle-type deflection coil 6 (which consists of copper wire turns enveloped by a thermoplastic material) is subjected to a thermal treatment after the winding process in the winding jig so that the thermoplastic envelopes of the turns have melted and a self-supporting assembly is obtained. The self-supporting deflection coil 6 is placed on an accurately formed jig 12 which supports the deflection coil 6 at a plurality of locations (A and B in FIG. 4). The inner surface 14 of coil support 5 is pressed against the outer surface 15 of the deflection coil 6. Subsequently a sonotrode 13 is externally provided for performing an ultrasonic welding operation. The weld is realised at a location of the coil support 5 under which a part of the deflection coil 6 supported by the jig 12 is situated. In principle, the number of welds is unlimited and welding may be performed at arbitrary locations. The (synthetic material) coil support 5 melts at the interface between the support and the coil and is pressed into the deflection coil 6 over a small distance (of the order of 1 mm). The position and the shape of the deflection coil 6 are then not affected. The result is a mechanical anchoring of the deflection coil 6 with respect to the support 5. Due to softening of the thermoplastic envelope of the turns, the adhesion of the deflection coil 6 to the support 5 is enhanced. Simultaneously, or not simultaneously, a second (line) deflection coil forming a diametrical system with the deflection coil 6 and being accurately positioned with respect to this coil is secured to the support 5 in an identical manner. Since this is effected identically, this step is not shown in FIG. 4. The method described above renders the use of snap connections, projections and the like superfluous so that one type of coil support can be used for supporting different types of deflection coil systems. If the deflection coil 6 itself is mechanically strong enough and thermally stable, an apertured coil support ("coil frame") may be used, which is advantageous with regard to, for example, thermal energy control, acoustical properties (hum).

The inner surfaces 17 of two field deflection coils 7 (FIG. 3) may be positioned and fixed on the outer surface of a coil support in an analogous manner. The coil support may be the coil support 5 with the outer surface 16.

A "supersmooth" construction is obtained by pressing the locally softened coil support into the deflection coils. Experiments have proved that the operational accuracy of the deflection units increases if the (line) deflection coils are built in a supersmooth manner. This is also the case if the (line) deflection coils are fixed by means of ultrasonic welding to the lugs secured to the support (particularly in such a way that they are free from the support).

This results in the following construction.

a. the method starts from thermo-stable coils 26, 26';

b. the support 25 comprises 3 parts:

a central part comprising a ring 27 with lugs 28, 28'. The ring material is preferably a (thermo-stable) thermoplastic material, so that ultrasonic welding is possible. The deflection coils, statically aligned by means of a positioning jig, are secured to the lugs by utrasonic welding. The coils are free from the support. This is favourable for:

unambiguous mounting (small spread) and correction of expansion differences (between the coil and the support), a neck portion 29 is secured to the rear extremity of the central part by means of, for example a snap connection or moulding. The neck portion 29 may be made of a different material, a funnel-shaped portion 30 may be secured to the front extremity of the central part by means of a snap connection or moulding. Here again a different type of material (for example, of lower cost) may be used.

We claim:

1. A deflection unit for a cathode ray tube comprising:

a. first and second saddle-type deflection coils preformed into predetermined shapes and disposed at predetermined positions relative to each other;

b. hollow synthetic-material coil-support means having permanent deformations, into which respective portions of said coils extend, for holding said coils in said predetermined shapes at said predetermined positions, said permanent deformations comprising impressions of said portions of said coils, and c. said coil support means includes at least two lugs into which respective ones of said permanent deformations are impressed such that said coils are substantially free from said coil support means.

2. A deflection unit as in claim 1 where the coil-support means comprises a first part having lugs and a second part secured to the first part, said lugs including portions extending away from a body portion of the first part and having respective ones of said deformations formed therein.

3. A deflection unit as in claim 2 where the lugs consist essentially of a thermoplastic material.

4. A deflection unit as in claim 1 where the coil-support means comprises first and second annular parts surrounding a common axis and having adjacent ends secured to each other, said first part including a plurality of lugs extending at an angle with respect to a body portion of said first part and having respective ones of said deformations formed therein.

5. A deflection unit as in claim 4 where the coil-support means includes a third annular part surrounding said axis and where the first and third annular parts have adjacent ends secured to each other.

6. The deflection unit as claimed in claim 1 wherein the saddle-type deflection coils are substantially free from the conical part of said coil support means.

* * * * *